US007153240B1

(12) United States Patent
Wu et al.

(10) Patent No.: US 7,153,240 B1
(45) Date of Patent: Dec. 26, 2006

(54) MEDICAL GYMNASTIC TREADMILL

(75) Inventors: Hung-Sheng Wu, Tuku Township, Yunlin County 663 (TW); Chun-Ho Chen, Taiping City, Taichung County (TW); Chih-Hun Hsu, South District, Taichung City (TW)

(73) Assignee: Taiwan Bicycle Industry R&D Center, Taichung (TW)

( * ) Notice: Subject to any disclaimer, the term of this patent is extended or adjusted under 35 U.S.C. 154(b) by 0 days.

(21) Appl. No.: 11/223,197

(22) Filed: Sep. 8, 2005

(51) Int. Cl.
*A63B 23/04* (2006.01)

(52) U.S. Cl. ..... 482/54

(58) Field of Classification Search ..... 482/51, 482/54, 908
See application file for complete search history.

(56) References Cited

U.S. PATENT DOCUMENTS 759,296 A * 5/1904 Morairty ..... 482/54
4,274,625 A * 6/1981 Gaetano ..... 482/54
6,010,432 A * 1/2000 Vawter ..... 482/54
6,695,750 B1 * 2/2004 Esteban ..... 482/54
6,821,233 B1 * 11/2004 Colombo et al. ..... 482/54

* cited by examiner

*Primary Examiner*—Stephen R. Crow
(74) *Attorney, Agent, or Firm*—Charles E. Baxley

(57) ABSTRACT

A medical gymnastic treadmill is disclosed to include two handrail assemblies each having a horizontal top rail a plurality of screw rods pivotally supported on the base frame of the treadmill body, vertical tubes respectively coupled between the top rail and the screw rods, a reversible motor, and a transmission mechanism coupled between the reversible motor and the screw rods for rotating the screw rods to move the tubes and top rails of the two handrail assemblies to the desired elevation at the same time upon rotation of the reversible motor.

14 Claims, 7 Drawing Sheets

MEDICAL GYMNASTIC TREADMILL

BACKGROUND OF THE INVENTION

1. Field of the Invention

The present invention relates to treadmill for physical therapy and more particularly, to such a medical gymnastic treadmill that allows synchronous adjustment of the height of the two handrails.

2. Description of the Related Art

A medical gymnastic treadmill is designed for a person having an injured leg or a patient not able to move freely to stand, walk or run upon. During the therapy course, a therapist may help the patient perform the exercise. However, in most time the patient must stand upon the tread belt of the treadmill by oneself so that the desired therapy effect is achievable. Therefore, a medical gymnastic treadmill has two handrails provided at two opposite lateral sides for the gripping of the user's hands during exercise. However, because different users have different body sizes, handrails of fixed height cannot suit and fit all users of different sizes. In order to fit different users, the length and width of the handrails of a medical gymnastic treadmill should be adjustable so that every user can use the machine safely without causing a secondary injury.

Many medical gymnastic treadmills with height-adjustable handrails are commercially available. U.S. Pat. No. 4,708,337 discloses a treadmill entitled "Automatic Treadmill, in which each handrail consists of an tube and an sleeve clamped by a nut, and a grip is provided on the sleeve touching the tapered portion of the nut. When the nut is turned loose, the grip on the sleeve is released. Thus, the tube and sleeve may be moved relative to each other to adjust the height of the handrail. After the desired height is reached, one can turn tight the nut for a tight fit between the inner and sleeves. This adjustment procedure is complicated and requires much time and labor. Further, it is difficult to adjust the two handrails to the same height.

Therefore, it is desirable to provide a medical gymnastic treadmill that eliminates the aforesaid problems.

SUMMARY OF THE INVENTION

The present invention has been accomplished under the circumstances in view. It is therefore the main object of the present invention to provide a medical gymnastic treadmill, which allows adjustment of the height of the two handrails thereof automatically.

To achieve these and other objects of the present invention, the medical gymnastic treadmill comprises a treadmill body, two handrail assemblies, and adjustment means. The treadmill body comprises a base frame, track means mounted on said base frame, a rotatable belt mounted on the track means upon which a user stands, and drive means mounted in the base frame for driving the track means to rotate the rotatable belt. The handrail assemblies are provided at two opposite lateral sides of the base frame of the treadmill body. The adjustment means is adapted to adjust the elevation of the handrail assemblies.

The handrail assemblies each comprise a horizontal top rail, a plurality of tubes respectively fixedly connected to and vertically downwardly extending from the horizontal top rail, and a plurality of screw rods respectively pivotally coupled between the tubes and the base frame of said treadmill body and rotatable clockwise/counter-clockwise to move the tubes vertically upwards/downwards. The adjustment means is adapted to rotate the screw rods to further move the tubes and the horizontal top rail to the desired elevation.

DETAILED DESCRIPTION OF THE PREFERRED EMBODIMENT

Figure 1A:
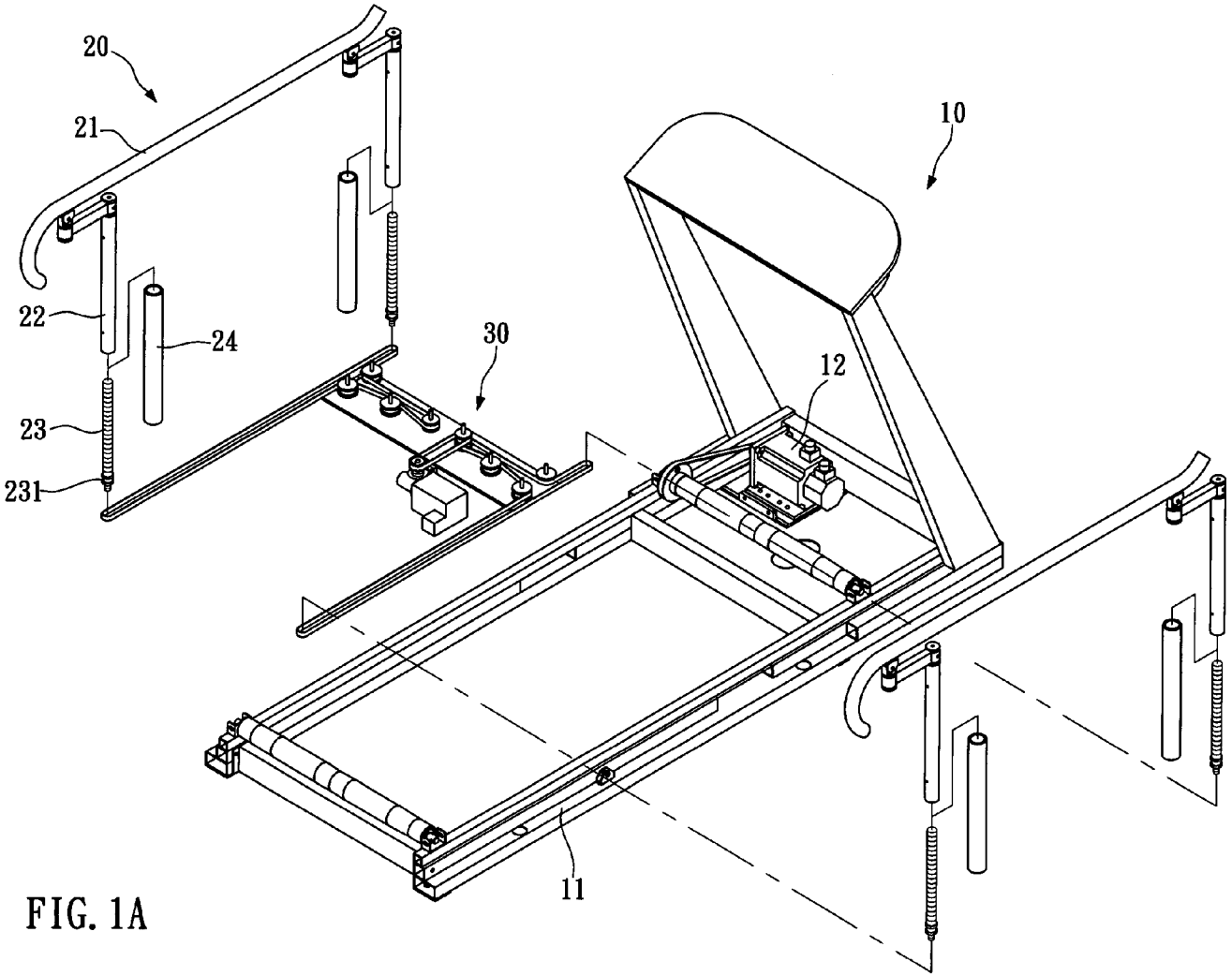
FIG. 1A is an exploded view of a medical gymnastic treadmill according to the present invention.
Figure 1B:
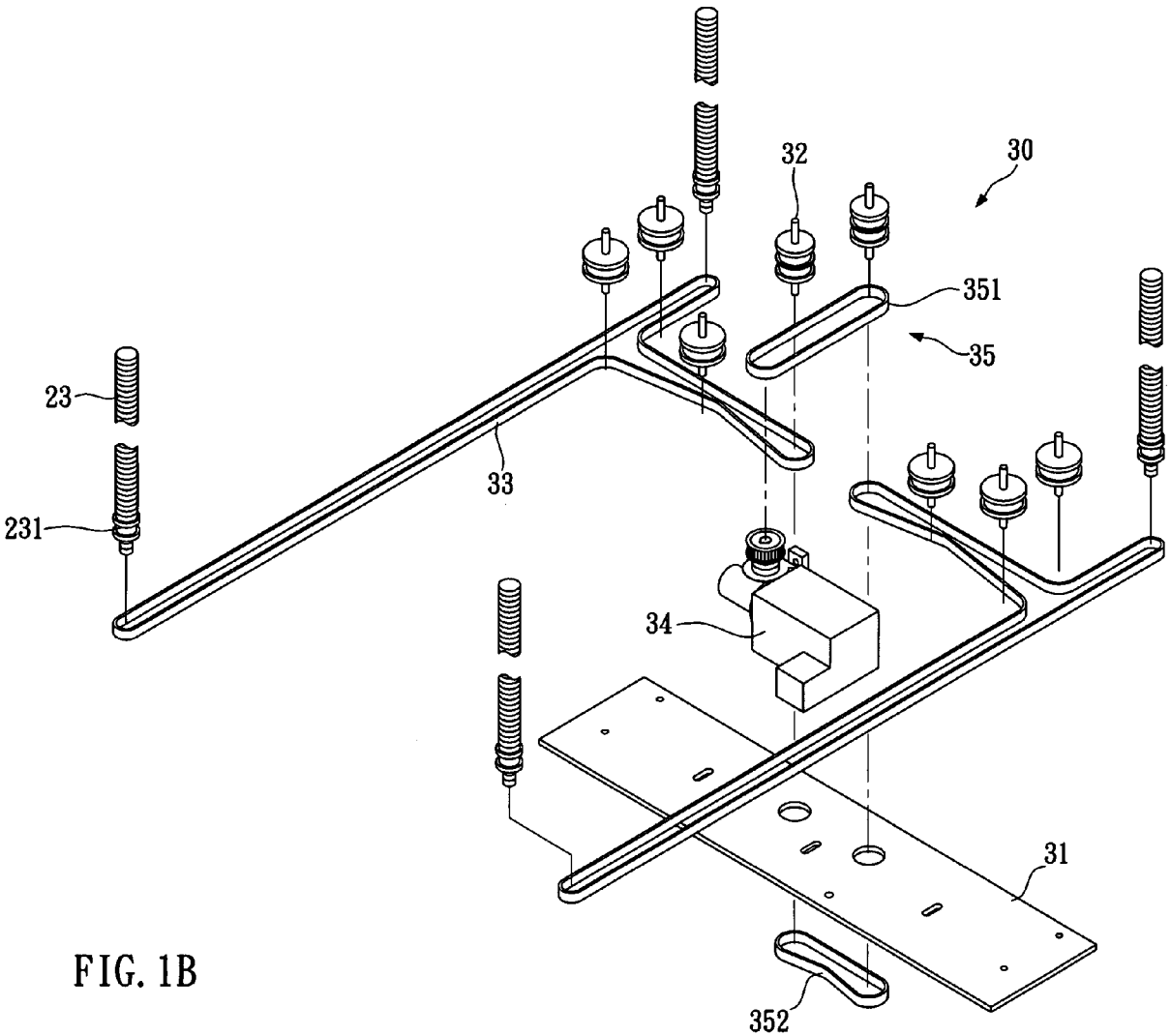
FIG. 1B is an exploded view in an enlarged scale of a part of the medical gymnastic treadmill shown in FIG. 1A, showing the structure of the adjustment unit.
Figure 2:
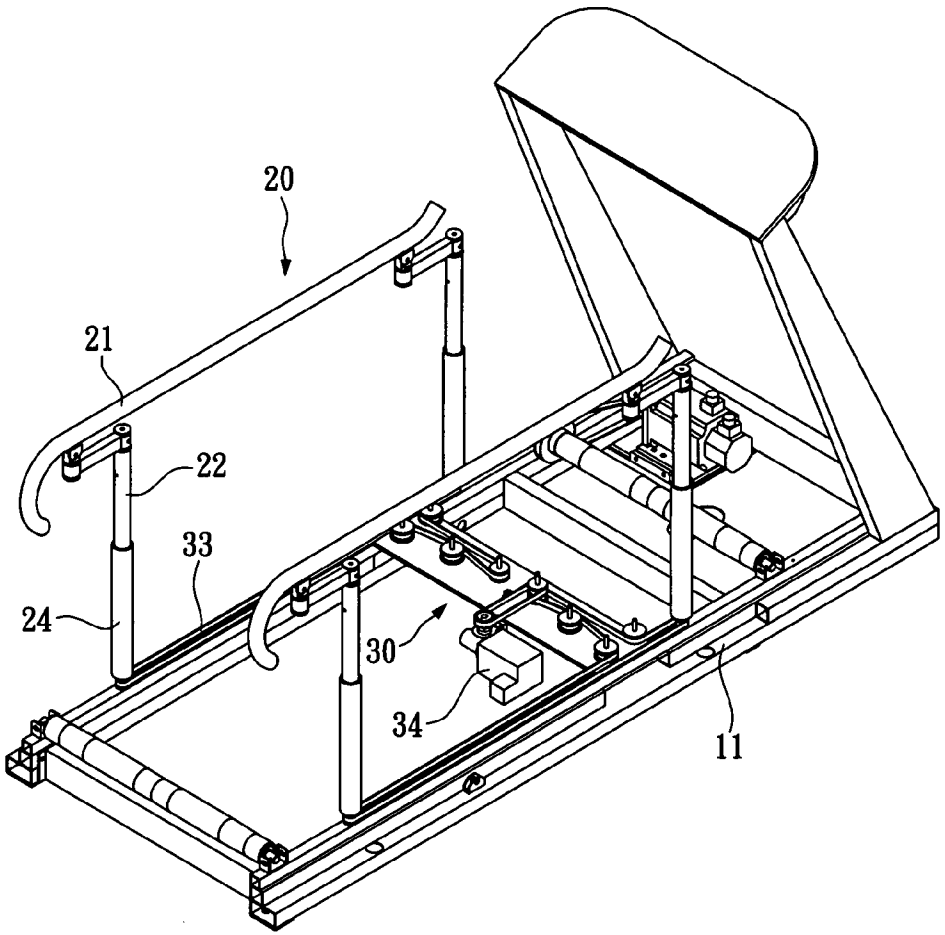
FIG. 2 is an elevational assembly view of the medical gymnastic treadmill according to the present invention.

Referring to FIGS. 1A, 1B and 2, medical gymnastic treadmill in accordance with the present invention is shown comprising a treadmill body 10, two handrail assemblies 20, and an adjustment unit 30.

The treadmill body 10 comprises a base frame 11, and a motor 12 mounted in the base frame 11 for driving track means to rotate a rotatable belt (not shown) upon which a user stands, walks or runs.

Figure 4B:
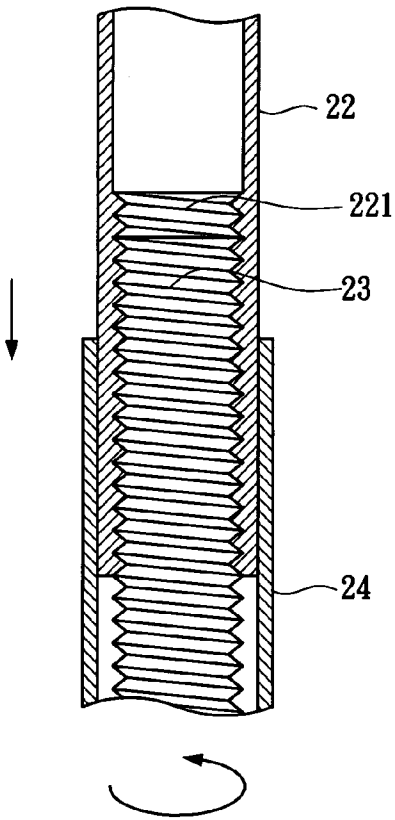
FIG. 4B is a schematic drawing showing the screw rod rotated counter-clockwise and the tube moved downwards relative to the sleeve according to the present invention.
Figure 4A:
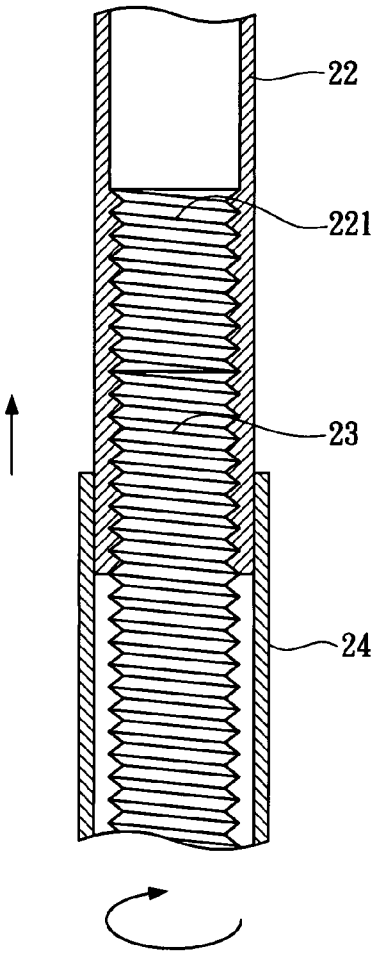
FIG. 4A is a schematic drawing showing the screw rod rotated clockwise and the tube moved upwards relative to the sleeve according to the present invention.

The handrail assemblies 20 are provided at two opposite lateral sides of the base frame 11 of the treadmill body 10, each comprising a plurality of sleeves 24 respectively fixedly mounted on the base frame 11 in vertical, a plurality of tubes 22 respectively coupled to and axially movable in and out of the sleeves 24, each tube 22 having an inner thread 221 spirally upwardly extending from the bottom end thereof to a certain distance (see also FIGS. 4A and 4B, a horizontal top rail 21 fixedly fastened to the top end of each of the tubes 22, a plurality of screw rods 23 respectively suspending in the sleeves 24 and respectively threaded into the inner thread 221 of each of the tubes 22, and a plurality of belt pulleys 231 respectively fixedly mounted on the bottom end of each of the screw rods 23.

The adjustment unit 30 comprises a mount 31 fixedly fastened to the base frame 11, two driving shafts 32 pivotally mounted on the mount 31, two adjustment belts 33 respectively coupled to the driving shafts 32 and the belt pulleys 231 at the screw rods 23 of the handrail assemblies 20, a motor 34 mounted on the mount 31, and a belt transmission mechanism 35 coupled between the motor 34 and the driving shafts 32. The belt transmission mechanism 35 comprises a transmission belt 351 coupled between the output shaft of the motor 34 and one of the driving shafts 32, and a synchronous belt 352 coupled between the two driving shafts 32. According to this embodiment, the motor 34 is a reversible motor. Starting the motor 34 to drive the belt transmission mechanism 35, the two adjustment belts 33 are rotated at the same time, and therefore the screw rods 23 of the handrail assemblies 20 are rotated at the same time. On the contrary, when stopped the motor 34, the screw rods 23 of the two handrail assemblies 20 are stopped at the same time. Further, guide rollers and tension rollers may be used to guide rotation or to control the tension of the adjustment belts 33.

Figure 3:
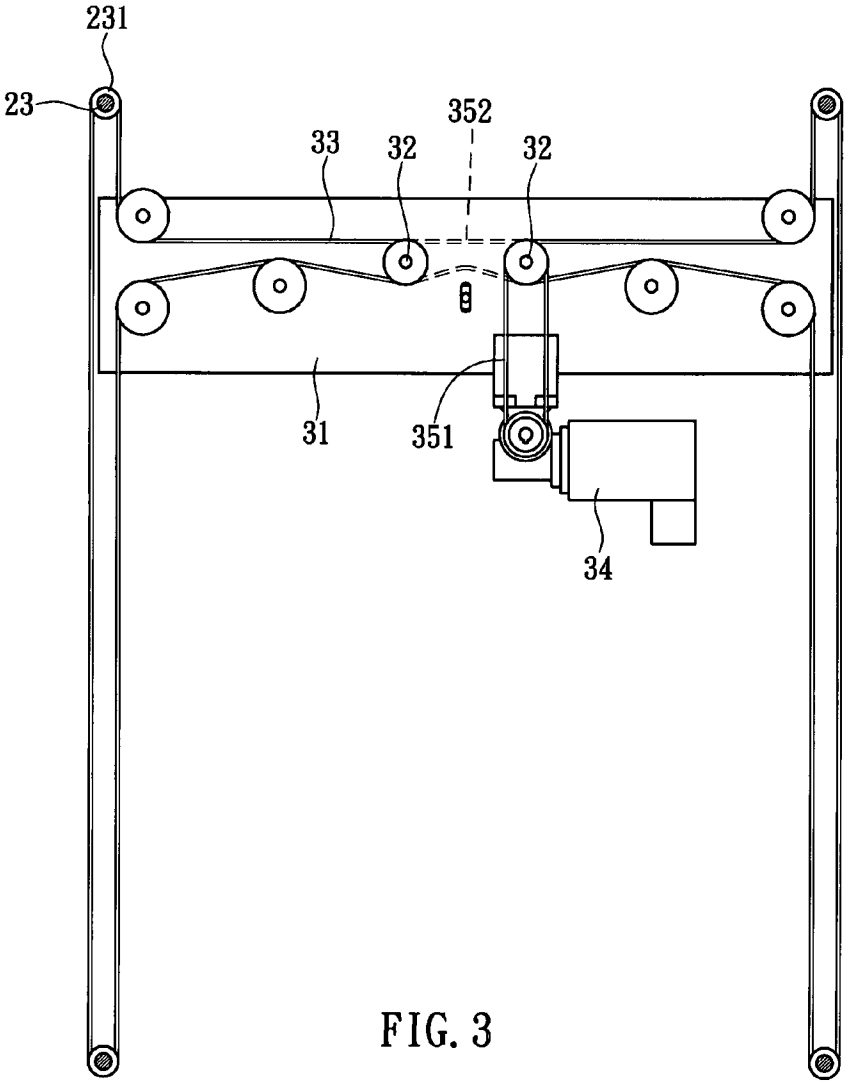
FIG. 3 is a top plain view of the adjustment unit according to the present invention.

Referring to FIG. 3, when user wishes to adjust the height of the top rails 21 of the handrail assemblies 20, operate the controller (not shown) to start the motor 34 in one direction, causing the transmission mechanism 35 to rotate the driving shafts 32 and then the adjustment belts 33, and therefore the screw rods 23 of the handrail assemblies 20 are rotated at the same time to move the respective tubes 22 upwards relative to the respective sleeves 24 (see FIG. 4A). After the top rails 21 of the handrail assemblies 20 have been adjusted to the desired height, stop the motor 34 so as to hold the top rails 21 of the handrail assemblies 20 firmly in the adjusted position.

On the contrary, when reversing the motor 34, the screw rods 23 are rotated in the reversed direction to lower the respective tubes 22 (see FIG. 4B), and therefore the top rails 21 of the handrail assemblies 20 are adjusted to the desired height.

Because controlling the operation of the motor 34 of the adjustment unit 30 achieves the adjustment of the height of the handrail assemblies 20, the adjustment of the elevation of the top rails 21 of the handrail assemblies 20 can easily and automatically be achieved with less effort.

Further, because the synchronous belt 352 is coupled between the two driving shafts 32, the driving shafts 32 are driven to rotate the screw rods 23 of the respective handrail assemblies 20 at the same time through the respective adjustment belts 33. Therefore, the height of the top rails 21 of the two handrail assemblies 20 are synchronously adjusted. Further, the control panel of the treadmill can be constructed to control the operation of the motor 34. Alternatively, an external controller may be used for allowing the therapist to adjust the height of the handrail assemblies 20 conveniently.

Further, the sleeves 24 accommodate and support the respective screw rods 23, and protect the respective screw rods 23 against external bodies.

Figure 5:
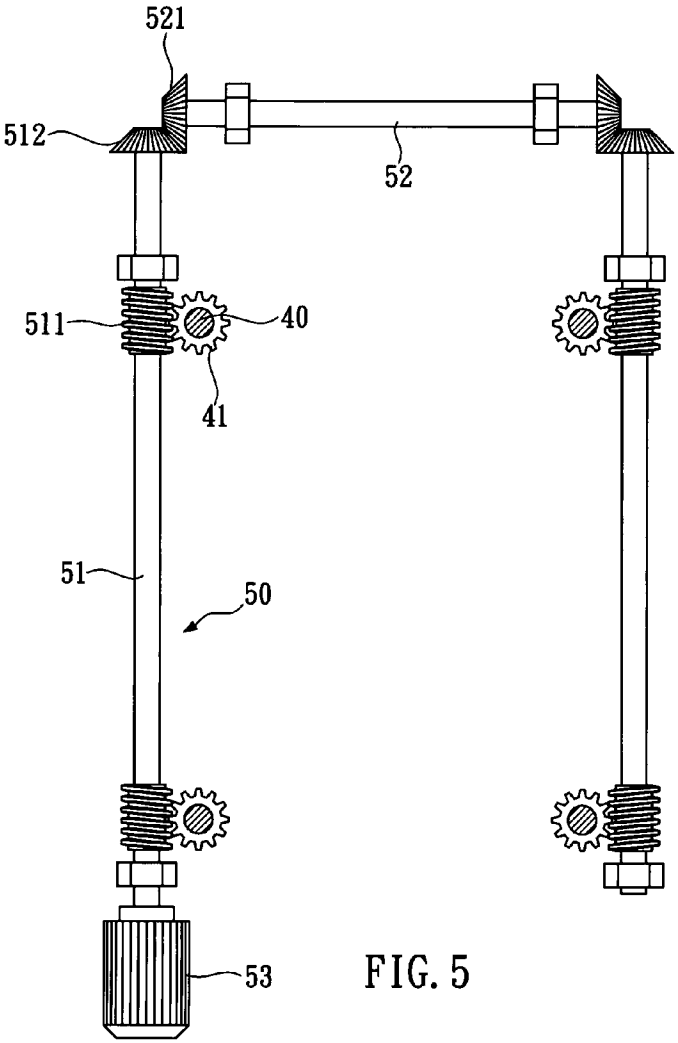
FIG. 5 is a schematic top plain view showing an alternate form of the adjustment unit according to the present invention.

FIG. 5 shows an alternate form of the present invention. According to this embodiment, each screw rod 40 of each handrail assembly (not shown) is fixedly mounted with a worm gear 41. Further, the adjustment unit, referenced by 50, comprises two longitudinal shafts 51 pivotally mounted in the base frame of the treadmill body (not shown) in longitudinal direction at two opposite lateral sides, a transverse shaft 52 pivotally mounted in the base frame of the treadmill body in transverse direction near the front side, a plurality of worms 511 respectively formed integral with the longitudinal shafts 51 and meshed with the worm gears 41 of the screw rods 40 of the handrail assemblies, two first bevel gears 512 respectively fixedly mounted on the front ends of the longitudinal shafts 51, two second bevel gears 521 respectively fixedly mounted on the two distal ends of the transverse shaft 52 and respectively meshed with the first bevel gears 512, and a motor 53 coupled to the rear end of one longitudinal shaft 51. This embodiment achieves the same effect.

Figure 6:
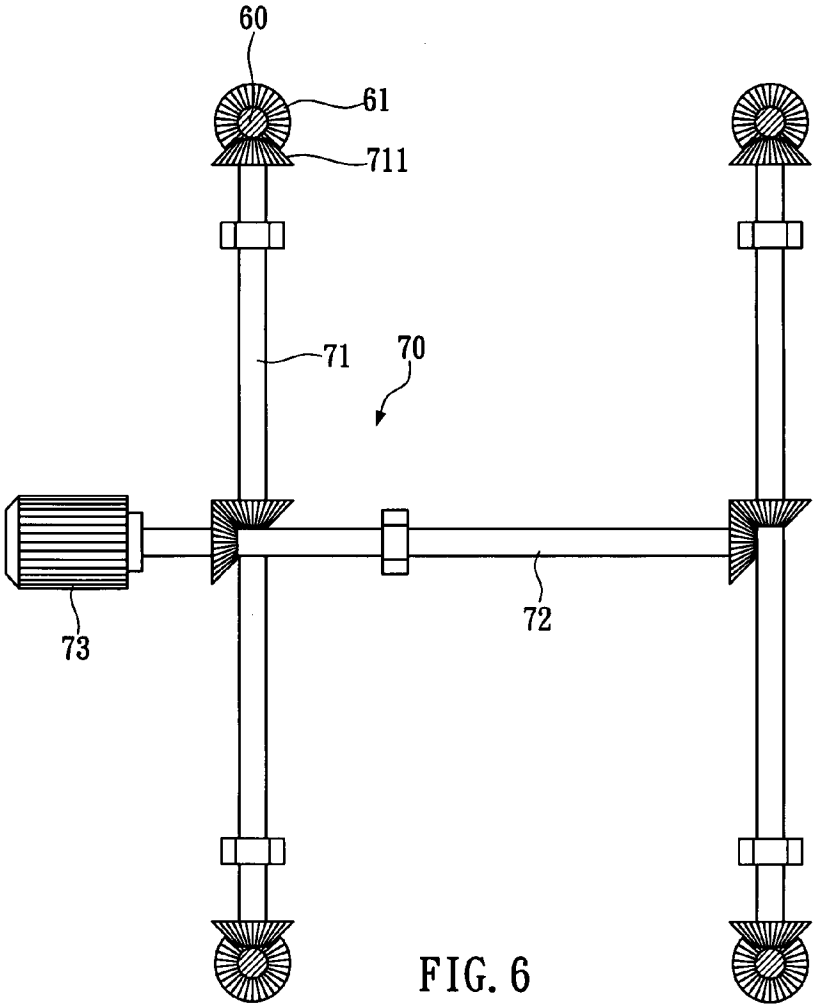
FIG. 6 is a schematic top plain view showing another alternate form of the adjustment unit according to the present invention.

FIG. 6 shows another alternate form of the present invention. According to this embodiment, each screw rod 60 of each handrail assembly (not shown) is fixedly mounted with a bevel gear 61. Further, the adjustment unit, referenced by 70, comprises two longitudinal shafts 71 pivotally mounted in the base frame of the treadmill body (not shown) in longitudinal direction at two opposite lateral sides, a plurality of bevel gears 711 respectively fixedly mounted on the longitudinal shafts 71 and meshed with the bevel gears 61 at the screw rods 60 of the handrail assemblies, a driving shaft 72 adapted to rotate the two longitudinal shafts 71 (through a gear transmission mechanism), and a motor 73 adapted to rotate the driving shaft 72. This embodiment achieves the same effect.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A treadmill comprising:

a treadmill body, said treadmill body comprising a base frame, track means mounted on said base frame, a rotatable belt mounted on said track means upon which a user stands, and drive means mounted in said base frame for driving said track means to rotate said rotatable belt;

two handrail assemblies provided at two opposite lateral sides of said base frame of said treadmill body; and adjustment means for adjusting the elevation of said handrail assemblies;

wherein said handrail assemblies each comprise a horizontal top rail, a plurality of tubes respectively fixedly connected to and vertically downwardly extending from said horizontal top rail, and a plurality of screw rods respectively rotatably coupled between said tubes and said base frame of said treadmill body and rotatable clockwise/counter-clockwise to move said tubes vertically upwards/downwards; said adjustment means is adapted to simultaneously rotate all said screw rods to further move said tubes and said horizontal top rail to the desired elevation.

2. The treadmill as claimed in claim 1, wherein said tubes each have an inner thread spirally extending in a bottom end thereof and respectively threaded onto said screw rods.

3. The treadmill as claimed in claim 2, wherein said handrail assemblies each further comprise a plurality of sleeves respectively fixedly fastened to said base frame of said treadmill body and adapted to accommodate said screw rods and said tubes.

4. The treadmill as claimed in claim 1, wherein said adjustment means comprises a mount fixedly mounted in said base frame of said treadmill body, two driving shafts pivotally mounted on said mount, two adjustment belts respectively coupled between said driving shafts and said screw rods for turning said screw rods upon rotation of said driving shafts, a reversible motor, and a belt transmission mechanism coupled between said reversible motor and said driving shafts for enabling said reversible motor to rotate said driving shafts.

5. The treadmill as claimed in claim 4, wherein said belt transmission mechanism comprises a transmission belt coupled between said reversible motor and one of said driving shafts, and a synchronous belt coupled between said driving shafts.

6. The treadmill as claimed in claim 4, wherein said screw rods each are fixedly mounted with a belt pulley and coupled to one of said adjustment belts.

7. The treadmill as claimed in claim 1, wherein said screw rods each are fixedly mounted with a worm gear and coupled to said adjustment means.

8. The treadmill as claimed in claim 1, wherein said adjustment means comprises two longitudinal shafts respectively rotatably mounted in said base frame of said treadmill body corresponding to said handrail assemblies, and a plurality of worms respectively formed integral with said longitudinal shafts and meshed with the worm gears at said screw rods.

9. The treadmill as claimed in claim 8, wherein said adjustment means further comprises a transverse shaft rotatably mounted in said base frame of said treadmill body and coupled between said longitudinal shafts, and a reversible motor adapted to rotate one of said longitudinal shafts and to force said transverse shaft to rotate the other of said longitudinal shafts.

10. The treadmill as claimed in claim 9, wherein said adjustment means further comprises two first bevel gears respectively fixedly mounted on said longitudinal shafts, and two second bevel gears respectively fixedly mounted on said transverse shaft and respectively meshed with said first bevel gears.

11. The treadmill as claimed in claim 1, wherein said screw rods each are fixedly mounted with a bevel gear and coupled to said adjustment means.

12. The treadmill as claimed in claim 11, wherein said adjustment means comprises two longitudinal shafts respectively rotatably mounted in said base frame of said treadmill body corresponding to said handrail assemblies, and a plurality of bevel gears respectively fixedly mounted on said longitudinal shafts and meshed with the bevel gears at said screw rods.

13. The treadmill as claimed in claim 12, wherein said adjustment means further comprises a transverse shaft rotatably mounted in said base frame of said treadmill body and coupled to said longitudinal shafts, and a reversible motor adapted to drive said transverse shaft to rotate said longitudinal shafts.

14. The treadmill as claimed in claim 13, wherein said adjustment means further comprises a gear transmission mechanism coupled between said transverse shaft and said longitudinal shafts.

* * * * *